United States Patent [19]

Ise

[11] 3,961,449

[45] June 8, 1976

[54] GRINDING MACHINE FOR HOUSEHOLD USE

[75] Inventor: Minoru Ise, Osaka, Japan

[73] Assignee: Ise Kogyo Kabushiki Kaisha, Osaka, Japan

[22] Filed: Aug. 27, 1975

[21] Appl. No.: 608,253

[30] Foreign Application Priority Data

Apr. 9, 1974 Japan ..... 49-106968[U]

[52] U.S. Cl. ..... 51/128; 51/134.5 F

[51] Int. Cl.[2] ..... B24B 3/36

[58] Field of Search ..... 51/109 R, 128, 134.5, 51/134.5 F

[56] References Cited

UNITED STATES PATENTS

| | | | |
|---|---|---|---|
| 2,077,195 | 4/1937 | Adams | 51/109 X |
| 2,227,697 | 1/1941 | Blood | 51/109 X |
| 2,813,376 | 11/1957 | Middlemark | 51/109 X |
| 3,383,805 | 5/1968 | Powell | 51/134.5 F |

*Primary Examiner*—Harold D. Whitehead
*Attorney, Agent, or Firm*—Holman & Stern

[57] ABSTRACT

Grinding machine comprising a rotary shaft vertically supportd by a housing, a whetstone mounted on the upper end of the shaft and having a top surface serving as a grinding surface, means for rotating the shaft by the pressure of tap water to rotate the whetstone at a high speed, water supply means for supplying water to the grinding surface at a suitable rate to form a layer of water thereon during the rotation of the whetstone and urging means for raising the shaft by the tap water pressure to urge the whetstone upward. The whetstone is upwardly urged to automatically control the grinding pressure on the article to be sharpened which is pressed against the grinding surface, while water is applied to the grinding surface at a suitable rate.

5 Claims, 5 Drawing Figures

GRINDING MACHINE FOR HOUSEHOLD USE

BACKGROUND OF THE INVENTION

The present invention relates to grinding machines for household use including a whetstone rotatable by the pressure of tap water to sharpen cutting implements such as kitchen knives, more particularly to a device in which water is automatically supplied to the grinding surface of a rotating whetstone to achieve an improved grinding efficiency and the grinding pressure acting between the grinding surface and an article pressed thereagainst for sharpening is automatically controllable.

While the article to be sharpened such as a cutting implement is pressed against the grinding surface of a rotating whetstone, there is the necessity of applying a suitable amount of water to the grinding surface to prevent degradation of the article due to the influence of frictional heat and to maintain the rough grinding surface. Furthermore the grinding pressure acting between the grinding surface of the rotating whetstone and the article pressed thereagainst for sharpening greatly influences the grinding ability of the whetstone. For household purposes, however, grinding machines are almost always used by unskilled persons, with the result that a proper amount of water may not always be applied to the grinding surface, or the grinding operation will not be conducted with an appropriate grinding pressure. At a low rate of water supply to the grinding surface, the resulting frictional heat reduces the hardness of the cutting edge, or particles lodge in and smooth the rough grinding surface, whereas excess water supply leads to waste of water. Especially with grinding machines in which the whetstone is rotatable by the pressure of tap water, the grinding pressure, when in excess, gives increased resistance to the rotating whetstone, greatly reducing the grinding efficiency. With an insufficient grinding pressure, the operation takes a longer period of time. In either case, therefore, water is wasted.

SUMMARY OF THE INVENTION

An object of this invention is to provide a grinding machine for household use including a whetstone rotatable by the pressure of tap water in which water can be supplied to the grinding surface of the whetstone always at a suitable rate during the rotation of the whetstone and in which the grinding pressure acting between the grinding surface and an article pressed thereagainst for sharpening is automatically controllable always to an optimum level.

Another object of this invention is to provide a grinding machine of the type described which is very simple in construction.

The present invention provides a grinding machine comprising a housing, a shaft rotatably supported by the housing in an upright position and a whetstone mounted on the upper end of the shaft and having a top grinding surface. The shaft has a small water passage vertically extending therethrough. A water supply member, serving also as a member for fastening the whetstone to the shaft, has a T-shaped water channel communicating with the water passage and having openings at the opposite sides of the member.

The rotary shaft is supported by an upper bearing formed on the top of the housing and a lower bearing provided in the center of a uniform pressure chamber within the housing. The lower bearing also serves to receive the thrust on the rotary shaft. The uniform pressure chamber has a water supply tube to be connected to a water supply line, or usually to a water faucet for household use, and has a sufficient space so as to maintain the pressure of the water introduced thereinto at as uniform a level as possible. The lower bearing is disposed in the center of top wall of the uniform pressure chamber and has a hole of a suitable diameter through which the chamber communicates with the interior of the bearing. The hole has a larger diameter than the water passage extending through the rotary shaft.

A large number of radial or like nozzles are formed in the peripheral wall of the uniform pressure chamber, whilst a turbinelike impeller is fixedly mounted on the rotary shaft. The blades of the impeller are arranged around the nozzles, such that the tap water forced out from the nozzles impinges on the blades to drive the rotary shaft.

According to this invention, the uniform pressure chamber is filled with water, which is led through the hole into the lower bearing. The water further flows through the water passage in the shaft and the T-shaped water channel of the water supply member and is forced out from the center of the whetstone over the upper surface thereof to form a uniform layer of water over the top surface of the whetstone in cooperation with the centrifugal force of the rotating whetstone. Thus the water absorbs the frictional heat of the grinding surface, cools the surface of the article to be ground and washes away the particles on the grinding surface which are produced by the grinding operation so as to keep the whetstone rough-surfaced. During the operation, the water is supplied to the grinding surface always at an appropriate constant rate which is determined by the specified diameter of the water passage or of the water channel.

On the other hand, because the hole of the lower bearing has a larger diameter than the water passage, the water filling the interior space of the bearing applies its pressure on the rotary shaft, thereby upwardly urging the shaft and consequently raising the whetstone. In counter relation to the urging force, the article to be sharpened is pressed against the grinding surface or the top surface of the rotating whetstone. Accordingly the upward force on the shaft counteracts the pressure of the article pressed against the grinding surface. Since the internal water pressure of the uniform pressure chamber is maintained at a constant level, the upward force delivered to the grinding surface through the rotary shaft is constant. Thus the grinding pressure between the grinding surface and the article pressed thereagainst can be automatically controlled.

Furthermore according to this invention, the hydraulic upward force maintains the rotary shaft at a raised position above the inner bottom surface of the lower bearing during the rotation of the whetstone. The hydraulic pressure therefore supports the load on the shaft acting in the direction of thrust. Further by suitably selecting the material of the lower bearing in combination with that of the shaft, the water filling the interior of the lower bearing can be made to act as a lubricant. Thus it is possible to remarkably reduce the frictional resistance against the rotation of the shaft and to greatly simplify the construction of the bearing.

Other objects and features of this invention will become more apparent from the following description.

DESCRIPTION OF THE PREFERRED EMBODIMENTS

Figure 1:
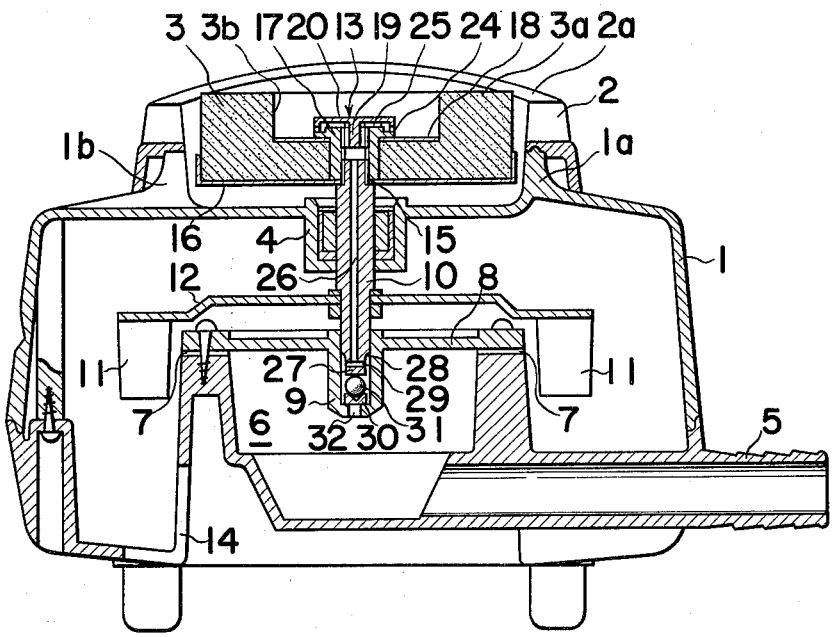
FIG. 1 is a front view in vertical section showing an embodiment of this invention.

With reference to FIG. 1, a housing 1 made of suitable material such as plastics is provided on its top with an annular cutlery support 2 having an appropriate height. Disposed inside the support 2 is a rotatable whetstone 3 having an upper surface serving as a grinding surface *3a*. The top surface *2a* of the support 2 is inclined at a suitable angle so that the edge of article such as kitchen knife (not shown) to be placed on the support 2 for sharpening can be pressed against the grinding surface *3a* at a suitable angle.

An upper bearing 4 is provided in the center of upper wall of the housing 1 which wall is surrounded by the cutlery support 2. A water supply tube 5 to be connected to a household water faucet (not shown) or the like projects from a lower side portion of the housing 1. The tube 5 is in communication with a uniform pressure chamber 6 positioned in the center of interior of the housing 1.

The uniform pressure chamber 6 has a sufficient space, such that the pressure of the tap water supplied from the tube 5 can be maintained at as uniform a level as possible within the chamber 6. A large number of radial or spiral nozzles 7 are formed in the periphery of the chamber 6. Thus water is forced out from all the nozzles 7 at a uniform pressure.

In the center of top plate 8 of the uniform chamber 6 there is a cup-shaped lower bearing 9 rotatably supporting the upright rotary shaft 10 of the whetstone 3 in cooperation with the upper bearing 4. An impeller 12 having a number of blades 11 resembling turbine blades is fixedly mounted on the rotary shaft 10 approximately at the midportion thereof. The blades 11 are arranged around the nozzles 7. Accordingly, the jets of water from the nozzles 7 strike the blades 11, causing the impeller 12 to drive the rotary shaft 10 at a high speed.

The whetstone 3 with the top grinding surface *3a* is fixed by a water supply member 13 to the upper end of the rotary shaft 10 extending upward from the upper bearing 4 and is therefore rotatable with the shaft 10. After impinging on the blades 11 of the impeller 12, the water flows out from the machine through an opening 14 in the inner bottom of the housing 11.

The upper extension of the rotary shaft 10 extending upward from the housing 1 is formed with a stepped portion 15 supporting a flanged disk 16 for receiving the whetstone. The whetstone 3 mounted on the disk 16 is secured to the upper end of the shaft 10 by the bush 17 of the water supply member 13.

Figure 2:
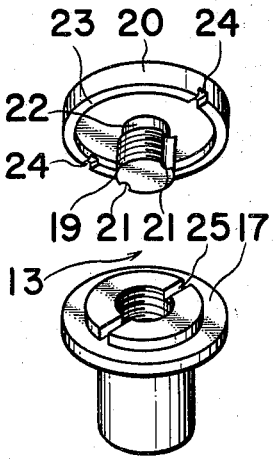
FIG. 2 is a perspective view showing a water supply member formed with a T-shaped water channel.
Figure 3:
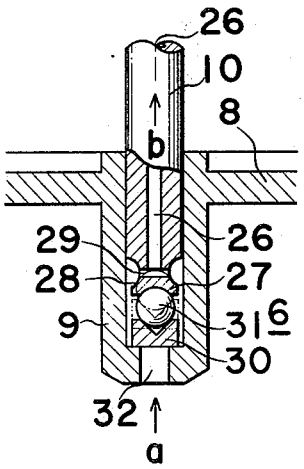
FIG. 3 is an enlarged view in vertical section showing the details of a lower bearing for supporting the lower end of a rotary shaft.

The water supply member 13 comprises the above-mentioned bush 17 and a cap member 20. The bush 17 fits in the bore of the whetstone 3 and has a threaded bored portion engageable with a threaded portion at the upper end of the rotary shaft 10 to fasten the whetstone 3 to the shaft 10, with a washer 18 interposed therebetween. The cap member 20 has a threaded portion 19 engageable in the threaded bored portion of the bush 17. As shown in FIG. 2, the cap member 20 is formed with vertical grooves 21 in its threaded portion 19, a circumferential groove 22 in the base of the threaded portion 19 and cutouts 24 in its outer peripheral annular flange 23. The bush 17 has a diametrical groove 25 in its top surface. When the cap member 21 is fitted over the bush 17 by screw-thread engagement, the vertical groove 21, circumferential groove 22, diametrical groove 25 and cutouts 24 are all brought into communication with each other to provide a water channel which is T-shaped and continuous as a whole. The water channel communicates with the upper end of a water passage 26 extending vertically through the rotary shaft 10. As illustrated in FIGS. 1 and 3, the lower end of the shaft 10 has a thrust ball seat 27 having a smaller diameter than the interior space of the lower bearing 9. Immediately above the ball seat 27, the shaft 10 has a grooved portion 28 having a diametrical bore 29 extending therethrough. The water passage 26 communicates with the interior space of the lower bearing 9 through the diametrical bore 29. A vertically movable ball seat 30 is placed on the inner bottom surface of the lower bearing 9, with a sufficient clearance formed between the seat 30 and the inner peripheral surface of the lower bearing 9. The thrust ball seat 27 at the lower end of the shaft 10 is supported by the seat 30, with a ball 31 interposed therebetween. The bottom of the lower bearing 9 has a hole 32 through which the interior space of the bearing 9 communicates with the uniform pressure chamber 6. The hole 32 has a larger diameter than the water passage 26.

When water is supplied to the uniform pressure chamber 6 through the water supply tube 5 connected to the unillustrated faucet, the water forced out from the nozzles 7 impinges on the blades 11 of the impeller 12 and drives the shaft 10 to rotate the whetstone 3 at a high speed. At the same time, the hydraulic pressure within the chamber 6 acts on the ball seat 30 through the hole 32 as indicated by an arrow *a* in FIG. 3, pushing up the ball seat 30 as indicated by a phantom line in FIG. 3 to raise the shaft 10 and whetstone 3 through the ball 31 as indicated by an arrow *b*. With the ball seat 30 in its raised position, water flows through the hole 32 and around the ball seat 30 to fill the interior space of the lower bearing 9. The water further passes through the bore 29, passage 26 and T-shaped channel of the water supply member 13, into the recess *3b* of the whetstone 3. The centrifugal force produced by the rotation of the whetstone 3 applies the water to the grinding surface *3a* of the whetstone 3. As already stated, the rate of water supply to the grinding surface *3a* is suitably regulated by the diameter of the water passage or channel, whilst the force to raise the shaft 10 is determined by the pressure receiving area of the rotary shaft 10, namely the sectional area of the shaft 10 minus the sectional area of the water passage 26, since the diameter of the hole 32 is larger than the diameter of the water passage 26. Accordingly when the pressure receiving area is suitably determined, a proper grinding pressure can be given to the article to be sharpened which is placed on the support 2 and pressed against the grinding surface 3*a*. Because the ball seat 30 serving to receive the thrust on the shaft 10 is raised from the bottom surface of the lower bearing 6 by the pressure of water in the chamber 6, the frictional resistance which would otherwise result from the thrust load is nullified. The cutlery support 2 may be removably mounted on the upward projection 1*a* of the housing 1 as seen in FIG. 1. The water applied to the grinding surface 3*a* is allowed to flow through a cutout portion 1*b* in the projection 1*a* and then over the outer wall of the housing.

Figure 4:
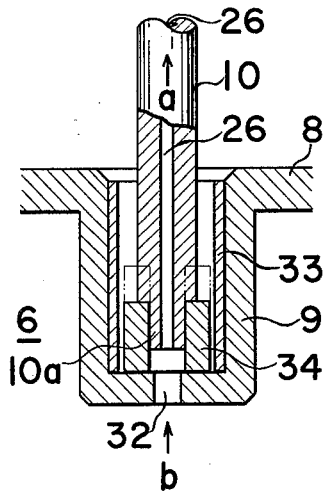
FIG. 4 is an enlarged view in vertical section showing another embodiment of the lower bearing.

FIG. 4 shows another embodiment of the lower bearing 9 for supporting the lower end of the rotary shaft 10 and for introducing water to the water passage 26 while upwardly urging the shaft 10. The cuplike lower bearing 9 is formed integrally with the top plate 8 of the uniform pressure chamber 6 and has a hole 32 through which the interior space of the bearing 9 communicates with the chamber 6. A bush 33 made of slidable material fits in the bearing 9.

The rotary shaft 10 having the water passage 26 vertically extending therethrough is formed at its lower end with a stepped portion 10*a* having a reduced diameter. A hollow cylindrical seat 34 fits in the bush 33, with a suitable clearance provided therebetween. The stepped portion 10*a* loosely fits in the bore of the cylindrical seat 34.

Simultaneously when the whetstone is initiated into rotation with tap water supplied to the chamber 6 as already stated, the pressure of the water in the chamber 6 is delivered through the hole 32 as indicated by an arrow *b* to the interior of the lower bearing 9, raising the rotary shaft 10 and seat 34 to the phantom-line position as indicated by an arrow *a*. Furthermore the water filling the interior space of the bearing 9 flows through the passage 26 to the grinding surface.

Because the suitable clearance is provided between the seat 34 and the inner peripheral surface of the bush 33, with the seat 34 loosely fitted around the rotary shaft 10, the clearance permits the deflection of axis of the shaft 10 when the shaft is brought into rotation and is therefore effective in facilitating the initiation of rotation. When the speed of rotation of the shaft 10 increases, the resulting centripetal force eliminates the deflection of axis of the shaft 10 as already known. Since the deflection of axis of the rotary shaft inevitably occurs upon initiation of rotation especially when the whetstone has a large mass relative to the rotary shaft, it is rather advantageous to permit such deflection in relieving the lower bearing of an objectional load.

Figure 5:
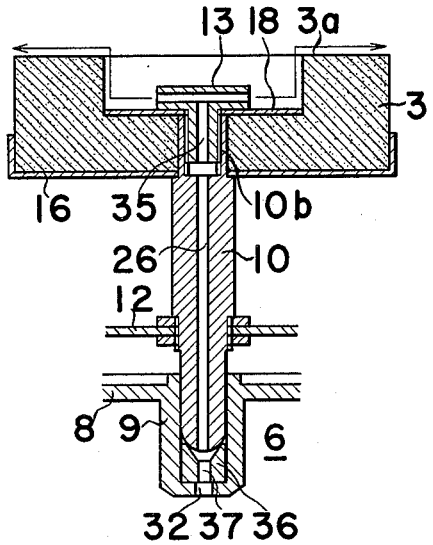
FIG. 5 is a view in vertical section showing the principal part of another embodiment.

FIG. 5 shows an integrally made embodiment of the water supply member 13. The upper end 10*b* of the rotary shaft 10 is in the form of a hollow cylinder and directly fits in the bore of the whetstone 3. A pluglike water supply member 13 has a threaded portion 13*a* which is screwed into the threaded bored portion of the cylindrical upper end of the shaft 10 to fixedly fasten the whetstone 3 to the shaft 10. The water supply member 13 has a T-shaped water channel 35 from which water jets out to form a water layer on the grinding surface 3*a*.

A dishlike seat 36 vertically slidably fits in the lower bearing 9 shown in FIG. 5 and supports the semispherical lower end of the rotary shaft 10. The seat 36 has a bore 37 extending therethrough and having a diameter slightly smaller than the diameter of the hole 32 and larger than the diameter of the water passage 26. The pressure of water in the uniform pressure chamber 6 therefore acts through the hole 32 and bore 37 on the pressure receiving surface of the shaft 10. The pressure also raises the seat 36 when the shaft 10 is raised. At this time, the dishlike concave surface of the seat 36 is slightly in contact with the semispherical lower end of the shaft 10 to help the rotary shaft to overcome the deflection of axis produced upon the initiation of rotation for further centripetal rotation.

What is claimed is:

1. A grinding machine for household use comprising:

a rotary shaft vertically supported by an upper bearing and a lower bearing mounted on a housing, the rotary shaft having a small water passage extending vertically therethrough, a whetstone mounted on the upper end of the rotary shaft and disposed above the housing, the whetstone having a top surface serving as a grinding surface, drive means for rotating the whetstone along with the rotary shaft at a high speed by the pressure of tap water, the drive means including a uniform pressure chamber for receiving the tap water and adapted to maintain its internal pressure at as uniform a level as possible, nozzles formed in the periphery of the chamber and an impeller mounted on the rotary shaft and rotatable by the water forced out from the nozzles against the impeller, a water supply member including means for fastening the whetstone to the rotary shaft and having a T-shaped water channel communicating with the water passage of rotary shaft to form a water layer on the grinding surface during the rotation of the whetstone, and urging means for applying the pressure of water in the uniform pressure chamber to the lower end of the rotary shaft supported by the lower bearing to raise the whetstone along with the shaft and for supplying water to the water channel of the water supply member through the water passage of the rotary shaft.

2. A grinding machine as defined in claim 1 wherein the urging means includes a hole for permitting the uniform pressure chamber to communicate with the interior of the lower bearing and a seat disposed on the inner bottom of the lower bearing and upwardly movable by the pressure of water in the uniform pressure chamber to bring the interior space of the lower bearing into communication with the hole and to cause the water pressure of the chamber to act on the lower end surface of the rotary shaft.

3. A grinding machine as defined in claim 1 wherein the urging means includes a hole for permitting the uniform pressure chamber to communicate with the interior of the lower bearing and a hollow cylindrical seat loosely fitting around the lower end of the rotary shaft and disposed in the lower bearing with a suitable clearance formed between the seat and the inner peripheral surface of the lower bearing.

4. A grinding machine as defined in claim 1 wherein the urging means includes a hole for permitting the uniform pressure chamber to communicate with the interior of the lower bearing and a dishlike seat vertically slidably fitting in the lower bearing and having a bore extending therethrough at its center, the seat having a dishlike concave surface in contact with the lower end surface of the rotary shaft which end surface is semispherical.

5. A grinding machine as defined in claim 1 wherein a cutlery support surrounding the whetstone and having a suitably inclined upper end surface is mounted on the top of the housing.

* * * * *